United States Patent [19]

Mänttäri et al.

[11] Patent Number: 4,574,838

[45] Date of Patent: Mar. 11, 1986

[54] MEANS FOR SAVING ENERGY IN A HYDRAULIC CIRCUIT

[75] Inventors: Erkki Mänttäri, Jyväskylä, Finland; Juha Ilmoniemi, Leighton Field North, Australia

[73] Assignee: Valmet Oy, Finland

[21] Appl. No.: 557,170

[22] PCT Filed: Mar. 15, 1983

[86] PCT No.: PCT/FI83/00024

§ 371 Date: Nov. 3, 1983

§ 102(e) Date: Nov. 3, 1983

[87] PCT Pub. No.: WO83/03285

PCT Pub. Date: Sep. 29, 1983

[30] Foreign Application Priority Data

Mar. 16, 1982 [FI] Finland ..... 820900

[51] Int. Cl.[4] ..... F15B 13/06

[52] U.S. Cl. ..... 137/596.12; 91/451; 137/596.17

[58] Field of Search ..... 91/450, 451; 74/467; 184/6.1, 6.12; 137/596.12, 596.13, 596.17

[56] References Cited

U.S. PATENT DOCUMENTS 3,150,685 9/1964 Lohbauer et al. ..... 137/596.13
3,709,103 1/1973 Dukhovny et al. ..... 91/437

FOREIGN PATENT DOCUMENTS 0015296 9/1980 European Pat. Off. .
2232832 2/1973 Fed. Rep. of Germany .
2301648 7/1974 Fed. Rep. of Germany .
2112813 7/1980 Fed. Rep. of Germany .
57305 3/1980 Finland .

*Primary Examiner*—Gerald A. Michalsky
*Attorney, Agent, or Firm*—Steinberg & Raskin

[57] ABSTRACT

The invention concerns a means for saving energy in a hydraulic circuit where pressurized oil supplied by a hydraulic pump is used to activate various functions by the aid of one or several valves (2,3,4) controlling the function. Such a hydraulic circuit is especially suitable for use in agricultural tractors, where the pressurized oil comes from a hydraulic pump driven by the engine. In conventional hydraulic circuits, a drawback is that the pressurized oil is directed through a pressure regulating valve, thereby causing unnecessary waste of energy and a need to cool the oil. This drawback is eliminated, as taught by the invention, in that a free circulation valve (1) is connected into the hydraulic circuit to cooperate with the valves (2,3,4) controlling the different functions in such manner that when at least one of the function-controlling valves (2,3,4) is open the free circulation valve (1) is closed and that when all function-controlling valves (2,3,4) are closed the free circulation valve (1) is open.

2 Claims, 1 Drawing Figure

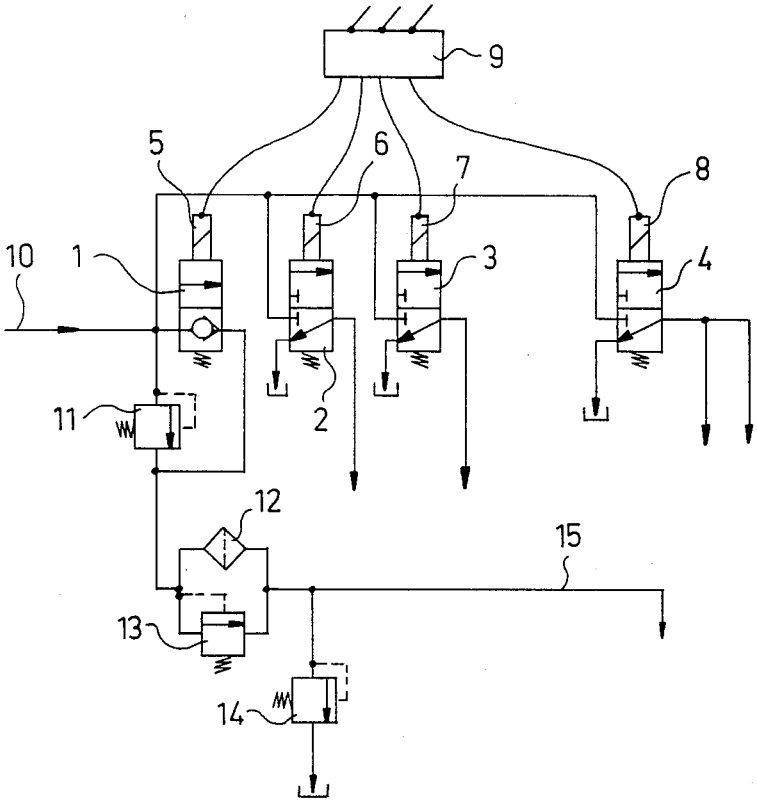
9
5
6
7
8
10
1
3
4
2
11
12
15
13
14

MEANS FOR SAVING ENERGY IN A HYDRAULIC CIRCUIT

BACKGROUND OF THE INVENTION

The present invention concerns a means for saving energy in a hydraulic circuit in which pressurized oil supplied by a hydraulic pump is used to activate various functions with the aid of one or several valves controlling these functions. Such a hydraulic circuit is especially suited for use in agricultural tractors. A tractor usually incorporates a system in which the hydraulic control circuit of the differential lock, the power take-off shaft, the high-speed gear or another equivalent hydraulically operated clutch has been connected to the lubricating circuit of the tractor's mechanical shifting gear. The pressurized oil to such a circuit comes from a hydraulic pump driven by the engine.

Since in such an arrangement the coupling elements require a pressure on the order of 1.5 MPa, and only a liquid flow sufficient to fill the operating cylinder, while for the lubrication of the shift gears is required a sizeable flow at a pressure not higher than 0.4 MPa, there must be some kind of throttling point in the system before the gear lubricating circuit, to raise the pressure to be proper for the said coupling means. A 1.5 MPa pressure regulating valve, for instance, is proper to be used to do this. However, this entails that the lubricating oil for the shift gears has to be driven against 1.6 MPa back pressure all the time, and this involves unnecessary waste of energy as well as need to cool the oil.

To overcome this drawback, a pressure-controlled free circulation valve by-passing the pressure regulating valve has been used, said valve being switched into action with the aid of the pressure rising in the circuit in question when none of the coupling valves is in operation. A solution of this type however requires a pressure accumulator operating in the range of 1.6 to 2.0 MPa. This accumulator is an expensive piece of equipment and susceptible to damage.

It is also conventional to employ three-way directional valves which have been dimensioned liberally enough to enable oil to be driven through them continuously. No separate free circulation valve is then needed because the directional valve can be set in the free circulated position. This design is however bulky and costly.

SUMMARY OF THE INVENTION

The object of the present invention is to provide a hydraulic circuit of the type described above with a means for achieving energy savings and which is free of the drawbacks mentioned above. The invention is mainly characterized in that the means for saving energy is a free circulation valve associated with the hydraulic circuit and connected to cooperate with the valves controlling various functions in such manner that whenever at least one of the function-controlling valves is open the free circulation valve is closed and that the free circulation valve is open only when all function-controlling valves are closed. In this manner the free circulation valve requires no pressure accumulator and operates under a control which is separate from the hydraulic circuit.

According to an advantageous embodiment, solenoids for controlling the free circulation valve and the various function-controlling valves are provided, the switches of the solenoids' circuits being so cross-connected that the solenoid of the free circulation valve is without current when at least one special function has been switched on or coupled, whereby no oil will pass through the free circulation valve, and that the solenoid of the free circulation valve is energized when all special functions are switched off, whereby the oil will flow through the free circulation valve.

In this way is obtained a means which is highly reliable in operation and simple in construction being composed of inexpensive standard components. The arrangement taught by the invention provides efficient control of the free circulation valve, by the aid of which it is possible to save the wasted power caused by throttling at a pressure limiting valve and the need of a cooling means resulting from the oil-heating effect of this valve.

DETAILED DESCRIPTION OF THE DRAWING

In the following, the invention shall be described with the aid of an example, with reference to the attached drawing, presenting a hydraulic functional diagram associated with a tractor.

DESCRIPTION OF THE PREFERRED EMBODIMENTS

The pressurized oil arrives by the pipe 10 e.g. from a hydraulic pump driven by the tractor engine, and is divided among three pipes. The first of them goes to the valves 2,3 and 4, by which are coupled into action the tractor's power take-off shaft, differential lock and high-speed gear. The second pipe goes over the pressure regulating valve 11 further to the shift gear lubrication. This pipe incorporates before the shift gears, a filter circuit where the oil passes through a filter 12 or, if this filter should become blocked, through a pressure relief valve 13 to the shift gears by the pipe 15. Furthermore, a pressure relief valve 14 has been provided before the shift gears to prevent excessive pressure build-up in the gear box. The third pipe goes to the free circulation valve 1, through which the oil has access to the shift gear lubricating circuit, by-passing the pressure regulator valve 11.

The valves 1,2,3 and 4 are operated by the aid of solenoids 5,6,7 and 8, the electric circuits of these solenoids being controlled by the aid of a switching means 9. This switch has a design such that it switches on the circuit activating the free circulation valve 1 whenever none of the circuit activating special functions is energized.

The FIGURE illustrates that situation in which the tractor's engine is not running, whereby the valves are closed. The system operates as follows. As the ignition key is turned, the solenoid of the free circulation valve 1 is immediately energized and the free circulation valve opens. The free circulation valve is hereby already open in readiness when the tractor engine starts running. Thus the hydraulic pump will supply oil through the pipe 10, bypassing the pressure regulating valve 11, into the gear box. Thus the power losses of the liquid flow are mainly made up only of the pressure drops in the filter 12 and in the gear box, which are on the order of 0.1 MPa. But this pressure is not enough for the coupling means to engage the tractor's power take-off shaft or whatever. When at least one of these pieces of equipment is activated by suitable actuation of switching means 9, current to the solenoid 5 is interrupted at the switching means 9 and the free circulation valve 1 will close. The working liquid is now directed to the pressure regulating valve 11, of which the operating pressure is 1.6 MPa. Fluid under this pressure suffices to actuate the coupling means that has been activated. It is thus understood that during the coupling operation the oil going to lubricate the shift gears passes through the 1.6 MPa valve. When normal driving is once more resumed, that is when all of the valves 2,3 and 4 are inoperative, the valve 1 will open to place the free circulation in operation, and the oil going to the shift gears is conducted in an energy-conserving manner past the pressure regulating valve 11.

The invention is naturally not exclusively confined to agricultural tractors nor to the use of the special functions enumerated here: it may also be applied more broadly, within the scope of the claims stated hereinbelow.

We claim:

1. In a hydraulic circuit in which working fluid is supplied to activate at least one function, including a function control valve communicating with the working fluid for controlling the supply of working fluid to a respective function, the improvement comprising:

a free circulation valve connected into the hydraulic circuit communicating with the working fluid;

a plurality of solenoid means for opening and closing said free circulation and function control valves, each solenoid means being associated with a respective one of said valves;

said solenoid means associated with said free circulation valve functioning to close said free circulation valve when current thereto is interrupted;

solenoid control switching means for actuating selected ones of said functions by opening said solenoid means associated therewith, for interrupting current to said solenoid means associated with said free circulation valve thereby closing the latter to prevent working fluid from passing therethrough when at least one of said function control valves is open and for supplying current to said solenoid means associated with said free circulation valve thereby opening the same to permit working fluid to pass therethrough only when all of said function control valves are closed; and wherein said hydraulic circuit further includes a pressure regulating valve communicating with the working fluid and wherein said free circulation valve is connected in said hydraulic circuit in parallel with said pressure regulating valve to permit the working fluid to bypass said pressure regulating valve when said free circulation valve is open.

2. The combination of claim 1 wherein said solenoid control switching means are electrically operated by connection to a source of electrical current, and wherein said solenoid means close said free circulation valve and all of said function control valves when said solenoid control switching means is disconnected from said electrical current source, and wherein electrical current is supplied to said solenoid means associated with said free circulation valve to open the latter upon said solenoid control switching means being connected to said electrical current supply source, said function control valves remaining closed until respective functions are selectively actuated.

* * * * *